US006122850A

United States Patent [19]

Strzeletz

[11] Patent Number: 6,122,850

[45] Date of Patent: Sep. 26, 2000

[54] MOBILE BILLBOARD SYSTEM

[76] Inventor: Henryk Strzeletz, P.O. Box 363, Falls Hill Rd., Dallas, Pa. 18612

[21] Appl. No.: 09/190,117

[22] Filed: Nov. 12, 1998

[51] Int. Cl.[7] ..... G09F 21/04

[52] U.S. Cl. ..... 40/591; 40/558

[58] Field of Search ..... 40/591, 588, 590, 40/545, 558

[56] References Cited

U.S. PATENT DOCUMENTS

| | | | |
|---|---|---|---|
| 3,054,205 | 9/1962 | Sierpin | 40/558 |
| 3,802,103 | 4/1974 | Neff | 40/591 |
| 4,114,299 | 9/1978 | Brownlee | 40/591 X |
| 4,580,361 | 4/1986 | Hillstrom et al. | 40/591 X |
| 4,756,107 | 7/1988 | Hillstrom | 40/591 X |
| 5,379,540 | 1/1995 | Howard | 40/558 |
| 5,600,909 | 2/1997 | Hooper | 40/558 |
| 5,649,730 | 7/1997 | Ramos | 40/591 X |
| 5,657,566 | 8/1997 | Key | 40/591 X |
| 5,692,331 | 12/1997 | Tipke | 40/591 |
| 5,815,969 | 10/1998 | Brouwer | 40/591 X |
| 5,918,924 | 7/1999 | Cowan | 40/591 X |

*Primary Examiner*—Terry Lee Melius
*Assistant Examiner*—William L. Miller
*Attorney, Agent, or Firm*—Hunton & Williams

[57] ABSTRACT

A mobile advertising system for use in connection with a motor vehicle or other mechanized transport comprises a plurality of display panels mounted integrally to the sides and/or rear of the motor vehicle, the plurality of display panels being comprised of transparent material; and a light source for lighting the plurality of display panels from behind the display panels. The light source includes a plurality of fluorescent lightbulbs and a power source generator which generates electrical current to power the fluorescent lightbulbs.

8 Claims, 4 Drawing Sheets

MOBILE BILLBOARD SYSTEM

BACKGROUND OF THE INVENTION

This invention relates to an apparatus for displaying an advertisement or similar graphic on a moving object such as a truck, van or trailer and for a medium for displaying the advertisement wherein the advertisement may be changed periodically without having to remove the display, repaint the display or use another similarly cumbersome and/or expensive process.

There are currently a great variety of different types of displays that can be used to exhibit advertising on the sides of moving vehicles such as vans, buses or trucks. The deficiencies inherent in many of the current display means are the lack of permanency of them. Many are fabricated by painting the advertisement directly on the surface of the vehicle, or by applying sign panels to the vehicle using adhesives. These displays are expensive, difficult to install, and difficult to change in a timely fashion. In addition, their useful life is limited by constant exposure to the elements even when not in use. A painted display may fade or the paint can fleck off. Rigid signs or signs with protective enclosures are more impervious to the elements, but are cumbersome and limited in size and can often be prohibitively heavy, weighing down the vehicle on which they are installed.

There are also prior means for displays using tensioning panels which may be adapted for use on mobile surfaces. These systems offer the ability to change the display in a more timely manner, and the ability to roll up the panel for storage helps reduce environmental wear. However, the tensioning frames are typically complex to assemble and often quite costly. For example, U.S. Pat. No. 4,580,361 to Hillstrom et al. discloses a tensioning frame which employs edge rails with integral spring tensioners to apply tension to the periphery of an advertising panel. This system, however, is complex to assemble and prone to mechanical failure after prolonged environmental exposure. Moreover, the edge rails protrude significantly from the mounting surface and may be unusable with some vehicles.

SUMMARY OF THE INVENTION

It is therefore an object of the present invention to provide an advertising medium with the benefits of mobility and non-permanent display which can be quickly and easily changed when different products or services are desired to be promoted.

It is an additional object of the present invention to provide a mobile advertising medium with a long useful life.

It is a further object of the present invention to provide a mobile advertising medium with a display that is relatively inexpensive to manufacture and easy to install.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purposes of the invention, as embodied and broadly described herein, the mobile advertising system of this invention for use in connection with any motor vehicle or mechanized transport means, comprises a plurality of display panels mounted integrally to the sides and/or rear of the motor vehicle, the plurality of display panels being comprised of lexan material or other similar transparent material; and lighting means for lighting the plurality of display panels from behind the display panels, the lighting means including a plurality of fluorescent lightbulbs and a power source, the power source generating electrical current to power the plurality of fluorescent lightbulbs.

The accompanying drawings, which are incorporated in and constitute a part of this specification, illustrate one embodiment of the invention and, together with the description, serve to explain the principles of the invention.

DESCRIPTION OF THE PREFERRED EMBODIMENT

Figure 1:
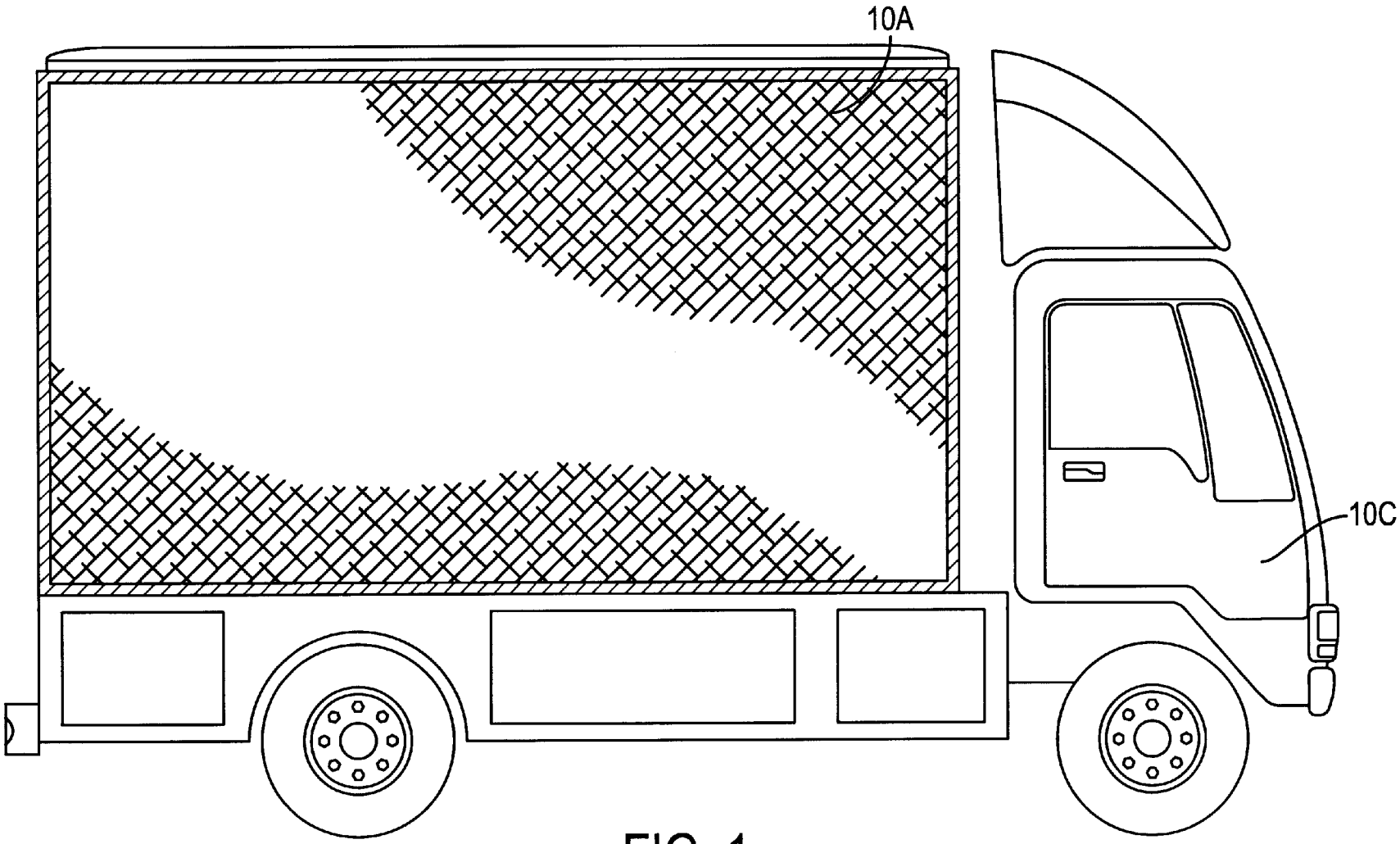
FIG. 1 is a side view of a truck utilizing the mobile advertising system of the present invention.

Reference will now be made in detail to the present preferred embodiment of the invention, an example of which is illustrated in the accompanying drawings in which like reference characters refer to corresponding elements.

The mobile advertising system of the present invention overcomes the deficiencies inherent in prior designs for mobile advertising in that the medium is such that it will not deteriorate due to exposure to the outside environment, it is relatively easy to change the message on the display by changing the back-lighting, and once the display panels are mounted on the motor vehicle, there is no further assembly required.

Figure 2A:
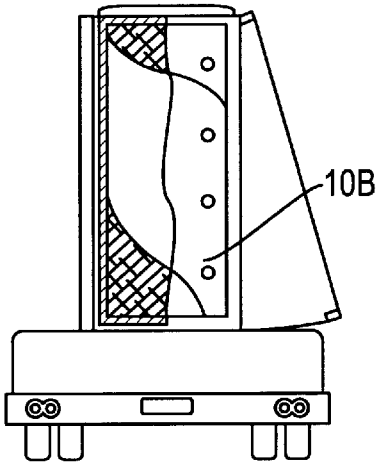
FIG. 2A is a rear view of the truck shown in FIG. 1.
Figure 3A:
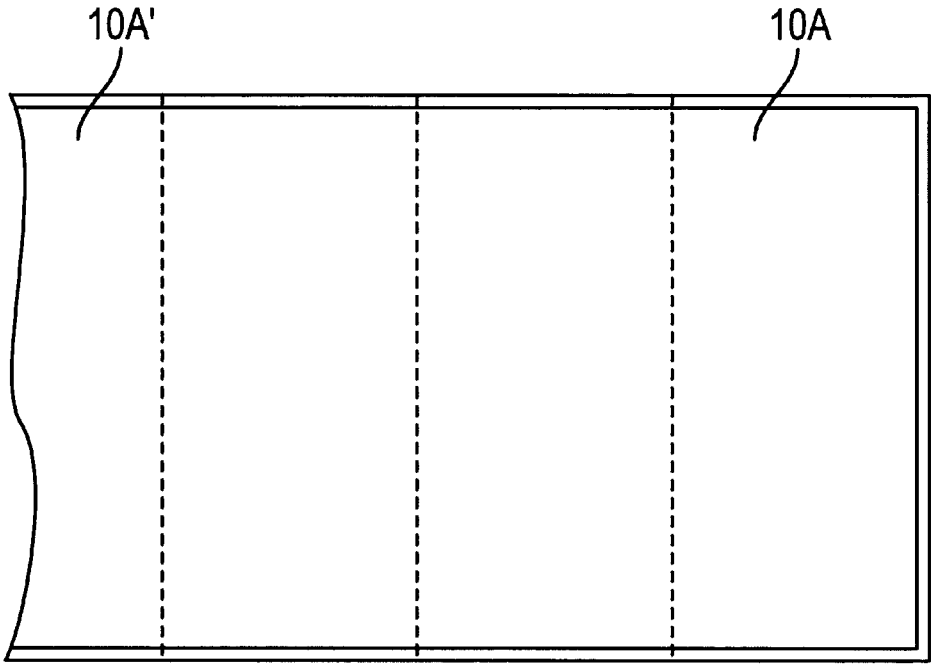
FIG. 3A is a more detailed drawing of a display panel for the mobile advertising system which is mounted on the side of the motor vehicle.
Figure 3B:
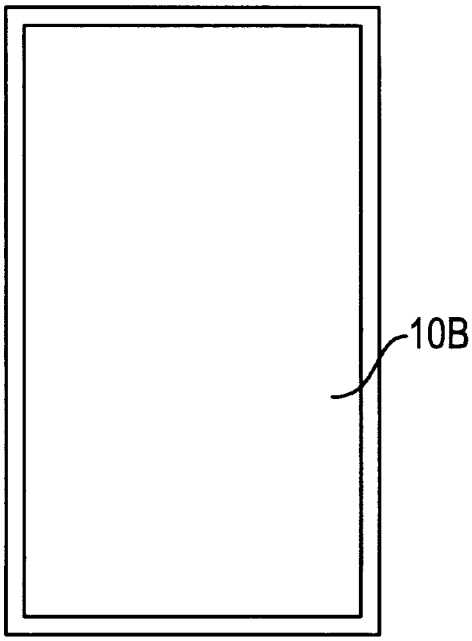
FIG. 3B is a more detailed drawing of the display panel of the mobile advertising system which is mounted the rear of the motor vehicle.

FIG. 1 illustrates a side view of a truck with a side display panel 10A of the mobile advertising system of the present invention mounted thereon. FIG. 3A illustrates the side display panel 10A. As shown, each side display panel 10A can be comprised of a plurality of individual sections of panel material 10A'. Each individual panel section 10A' can measure up to a maximum of 48 inches in width. Using four panel sections 10A' of 41 3/16 inches width each allows a side display panel 10A to be divided into four sections, of equal dimension with the entire side panel 10A having a 91 3/8 inches by 163 inches visible area dimension. Each side panel 10A also includes a 1 3/4 inch border around all four sides. A rear display panel 10B, as shown in FIGS. 2A and 3B, may also be mounted on a truck. Preferably the dimensions for such rear display panel 10B measure 24 inches by 81 inches for the visible area with a 1 1/2 inch border around each side of the rear display panel 10B. The display dimensions for both display panels 10A and 10B may be varied depending upon the dimensions of the chassis for the vehicle onto which such display panels are to be mounted.

As shown in FIG. 1, side display panel 10A may comprise a substantial portion of a lateral side of vehicle 100. As shown in FIG. 2A, rear display panel 10B may comprise a substantial portion of a rear side of vehicle 100.

The visible area for both the side display panel 10A and the rear display panel 10B is comprised of lexan, plexiglass or other similar transparent, but resilient material. Each display panel 10A and 10B is mounted on top of support boxes which are affixed to the vehicle.

Figure 2B:
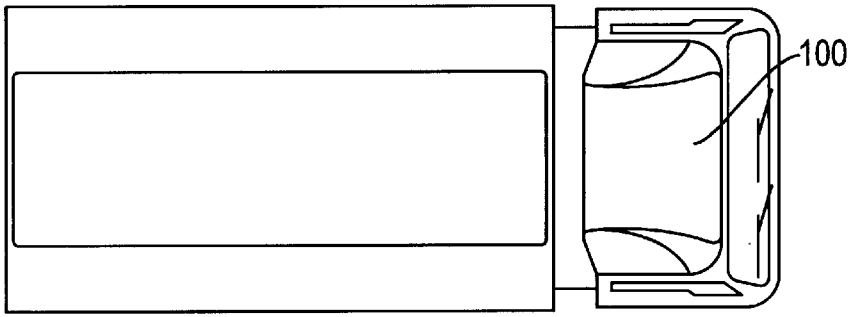
FIG. 2B is a top view of the truck shown in FIG. 1.
Figure 2C:
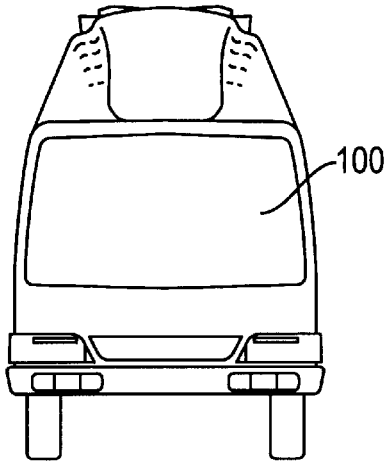
FIG. 2C is a front view of the truck shown in FIG. 1.

As shown in FIG. 2A, a transparent cover may be provided to cover and protect the display panels. As shown in FIGS. 2A–2C, vehicle 100 may comprise a truck with a substantially flat bed for supporting a support box or support boxes. The support box may be recessed from a lateral edge such that the display panels do not protrude laterally beyond the cab of vehicle 100.

Figure 4A:
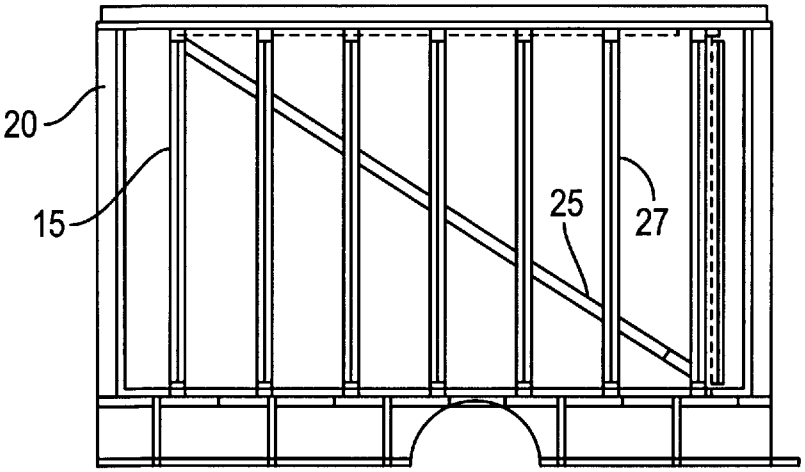
FIG. 4A is a side view of the interior of the truck showing the backlighting used to light a side display panel.
Figure 4B:
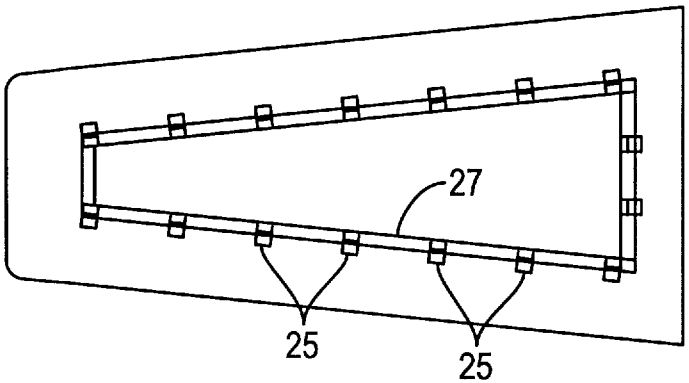
FIG. 4B is a top view of the interior of the truck.
Figure 4C:
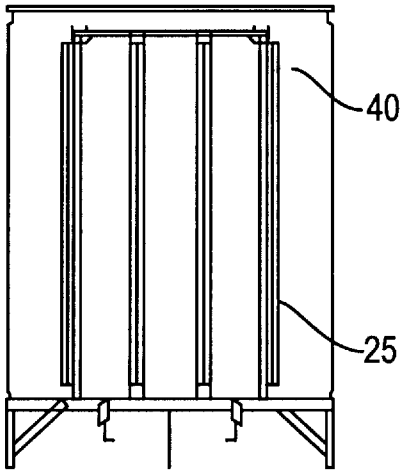
FIG. 4C is a rear view of the interior of the truck showing the lighting used to backlight a rear display panel.
Figure 4D:
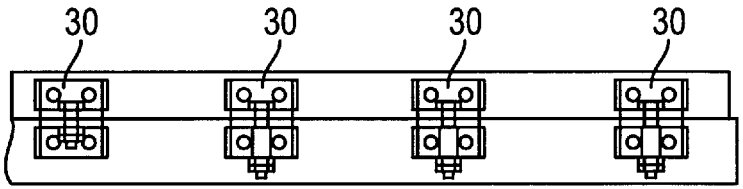
FIG. 4D illustrates mounting brackets used to mount the lighting assemblies.

The backlighting used to light the display panels, such as 10A and 10B, is illustrated in FIGS. 4A through 4D. A side view of the backlighting used for a side display panel 10A is shown in FIG. 5A. As shown, a side display panel 10A, such as shown in FIGS. 1 and 3A, is backlit by use of a plurality of long double-tube fluorescent lights 15. In the current example, 12 eight feet long fluorescent lights are used. They are mounted on a mounting body structure 20 which is comprised of a rectangular frame and which includes a plurality of mounting brackets 30, shown in FIG. 4D, for securing the mounting body structure 20 to the chassis frame of the vehicle. Preferably, the mounting brackets 30 are comprised of ABS steel and suitable insulation material because the mounting brackets 30 should be insulated from the aluminum of the vehicle chassis for safety reasons. The mounting body structure 20 includes a plurality of aluminum support channels 25 into which each fluorescent light 15 is to be secured. An angle clip is welded to structure 20 and bolted to each support channel 25 to provide additional support for maintaining the position of each fluorescent light 15. A single flat bar support 27 is welded in a diagonal manner to each light support channel 25. A top view of the interior of a vehicle which has two side display panels 10A and a rear display panel 10B mounted thereon is shown in FIG. 4B.

A rear view showing the backlighting used for a rear display panel 10B is shown in FIG. 5C. The rear backlighting assembly 40 comprises a bar assembly which is bolted to the two side mounting body structures 20. Assembly 40 includes a plurality of aluminum support channels 25 into which each fluorescent light 15 is to be secured. Assembly 40 also includes a plurality of angle clips similar to those discussed above with respect to structure 20 to support the channels 25.

The interior of the vehicle will also house the generator which will supply current to power the fluorescent lights. The power supply for such generator can be a typical 110 volt DC alternator power supply or a 24 volt battery.

It should be apparent to those skilled in the art that various modifications and variations may be made to the mobile advertising system of the present invention without departing from the scope or spirit of the invention. Thus, it is intended that the invention cover such modifications and variations of the invention, provided they come within the scope of the appended claims and their legally entitled equivalents.

What is claimed is:

1. A mobile advertising system for use in connection with a vehicle, comprising:

(a) at least one display panel for mounting on the vehicle, said display panel being comprised of transparent material;

(b) lighting means for mounting on the vehicle and lighting said plurality of display panels from behind said display panels, said lighting means including a plurality of fluorescent lightbulbs;

(c) a mounting structure for mounting said plurality of fluorescent lightbulbs to the body of the vehicle, said mounting structure comprising:

(i) a rectangular frame;

(ii) a plurality of aluminum support channels into one of which of said plurality of aluminum support channels one of said plurality of fluorescent lightbulbs is fitted and secured;

(iii) a plurality of clip means, one of said plurality of clip means for attaching one of said plurality of aluminum support channels to said rectangular frame; and (iv) a plurality of mounting brackets for attaching said frame to the body of the vehicle.

2. A mobile advertising system comprising:

a mounting structure, said mounting structure housing at least one light source including a fluorescent light bulb disposed in an aluminum support channel;

at least one translucent display panel mounted to said mounting structure, whereby at least a portion of the at least one light source illuminates said at least one translucent display panel from behind; and a vehicle supporting said mounting structure; and whereby said vehicle, said mounting structure, and said at least one translucent display panel comprise an assembly comprising a plurality of sides and said at least one translucent display panel comprises a substantial portion of at least one side of the assembly.

3. The mobile advertising system of claim 2, wherein said vehicle comprises a substantially flat bed for supporting said mounting structure.

4. The mobile advertising system of claim 2, further comprising a power source disposed within said mounting structure.

5. The mobile advertising system of claim 2, wherein said at least one display panel comprises a plurality of display panels, the plurality of sides of the assembly comprise a first lateral side and a second lateral side, and at least one of said plurality of display panels is disposed on the first lateral side and at least one of said plurality of display panels is disposed on the second lateral side.

6. The mobile advertising system of claim 2, wherein said at least one display panel is disposed on a rear side of the assembly.

7. The mobile advertising system of claim 2, further comprising at least one transparent cover disposed on said at least one display panel.

8. The mobile advertising system of claim 2, wherein said mounting structure is recessed from a lateral side of the vehicle, whereby said at least one display panel does not protrude laterally beyond a cab of the vehicle.

* * * * *